US005465979A

United States Patent [19]

Buhler

[11] Patent Number: 5,465,979

[45] Date of Patent: Nov. 14, 1995

[54] ARROWS WITH REDUCED DIAMETER NOCKS

[76] Inventor: Clayton K. Buhler, Box 136, Laglace, Alberta, Canada, T0H-2J0

[21] Appl. No.: 199,424

[22] Filed: Feb. 22, 1994

[51] Int. Cl.[6] ..... F42B 6/06

[52] U.S. Cl. ..... 273/416

[58] Field of Search ..... 273/416, 419–423

[56] References Cited

U.S. PATENT DOCUMENTS

| | | | |
|---|---|---|---|
| 1,794,051 | 2/1931 | Allen | 273/420 |
| 2,747,876 | 5/1956 | Teller | 273/420 |
| 4,050,696 | 9/1977 | Troncoso, Jr. | 273/420 |
| 4,533,146 | 8/1985 | Schaar | 273/422 |
| 4,645,211 | 2/1987 | Beiter | 273/416 |
| 5,154,432 | 10/1992 | Saunders | 273/416 |
| 5,269,534 | 12/1993 | Saunders et al. | 273/419 |
| 5,290,044 | 3/1994 | Easton et al. | 273/416 |
| 5,294,131 | 3/1994 | Manske | 273/416 |

*Primary Examiner*—Paul E. Shapiro

[57] ABSTRACT

An arrow with a reduced diameter nock comprising a cylindrical arrow shaft in a tubular configuration having a pointed end and a fetching end and an exterior diameter and an interior diameter. Fetching extends outwardly from the arrow shaft adjacent to the fetching end. A cylindrical bore extends into the arrow shaft at the fetching end, the bore having an internal diameter. A nock has a cylindrical forward end with an exterior diameter to frictionally fit into the bore of the arrow shaft, and has a rearward end of a diameter essentially equal to that of the exterior diameter of the arrow shaft, the inboard end being formed with a deep hole for an acute angle bowstring.

2 Claims, 2 Drawing Sheets

ARROWS WITH REDUCED DIAMETER NOCKS

BACKGROUND OF THE INVENTION

1. Field of the Invention

The present invention relates to arrows with reduced diameter nocks and more particularly pertains to reducing the exterior diameter of nocks to the exterior diameter of arrow shafts to improve arrow performance.

2. Description of the Prior Art

The use of arrows and nocks is known in the prior art. More specifically, arrows and nocks heretofore devised and utilized for the purpose of coupling nocks to arrows are known to consist basically of familiar, expected and obvious structural configurations, notwithstanding the myriad of designs encompassed by the crowded prior art which have been developed for the fulfillment of countless objectives and requirements.

The prior art discloses a large number of arrows and nocks and couplings therebetween. By way of example, U.S. Pat. No. 3,658,335 to Saunders discloses a string holding arrow nock.

U.S. Pat. No. 4,305,588 to Dodge discloses an archery arrow nock.

U.S. Pat. No. 4,544,163 to Scanlon discloses an arrow hock.

U.S. Pat. No. 4,645,211 to Belter discloses a nock for arrows of sport and hunting bows.

U.S. Pat. No. 4,943,067 to Saunders discloses an arrow insert.

Lastly, U.S. Pat. No. Des. 301,272 to Barrow discloses the design of an arrow nock.

In this respect, the arrows with reduced diameter nocks according to the present invention substantially departs from the conventional concepts and designs of the prior art, and in so doing provides an apparatus primarily developed for the purpose of reducing the exterior diameter of nocks to the exterior diameter of arrows to improve arrow performance.

Therefore, it can be appreciated that there exists a continuing need for new and improved arrows with reduced diameter nocks which can be used for reducing the exterior diameter of nocks to the exterior diameter of arrow shafts to improve arrow performance which can be used to couple nocks to arrows. In this regard, the present invention substantially fulfills this need.

SUMMARY OF THE INVENTION

In view of the foregoing disadvantages inherent in the known types of arrows and nocks now present in the prior art, the present invention provides improved arrows with reduced diameter nocks. As such, the general purpose of the present invention, which will be described subsequently in greater detail, is to provide a new and improved arrows with reduced diameter nocks and method which has all the advantages of the prior art and none of the disadvantages.

To attain this, the present invention essentially comprises a new and improved arrow with a reduced diameter nock comprising, in combination, a cylindrical arrow shaft in a tubular configuration having a pointed end and a fetching end and an exterior diameter and an interior diameter. Fetching extends outwardly from the arrow shaft adjacent to the fetching end. A cylindrical bore extends into the arrow shaft at the fetching end, the bore having an internal diameter. A nock has a cylindrical forward end with an exterior diameter to frictionally fit into the bore of the arrow shaft, and having a rearward end of a diameter essentially equal to that of the exterior diameter of the arrow shaft, the inboard end being formed with a deep hole for an acute angle bowstring. The forward end of the nock is formed as a slender cylinder with an external diameter less than that of the bore. A shaft with indented rings at measured intervals of equal weight which can be cut to desired length or weight and is frictionally fit inside the bore of the arrow to ensure proper bonding and also rotational adjustment for clearance of fletchings over the arrow rest.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved arrows with reduced diameter nocks which has all the advantages of the prior art arrows and nocks and none of the disadvantages.

It is another object of the present invention to provide a new and improved arrows with reduced diameter nocks which may be easily and efficiently manufactured and marketed.

It is a further object of the present invention to provide a new and improved arrows with reduced diameter nocks which is of a durable and reliable construction.

An even further object of the present invention is to provide a new and improved arrows with reduced diameter nocks which is susceptible of a low cost of manufacture with regard to both materials and labor, and which accordingly is then susceptible of low prices of sale to the consuming public, thereby making such arrows with reduced diameter nocks economically available to the buying public.

Still yet another object of the present invention is to provide a new and improved arrows with reduced diameter nocks which provides in the apparatuses and methods of the prior art some of the advantages thereof, while simultaneously overcoming some of the disadvantages normally associated therewith.

Still another object of the present invention is reduce the exterior diameter of nocks to the exterior diameter of arrow shafts to improve arrow performance.

Lastly, it is an object of the present invention to provide a new and improved arrow with a reduced diameter nock comprising a cylindrical arrow shaft in a tubular configuration having a pointed end and a fetching end and an exterior diameter and an interior diameter. Fetching extends outwardly from the arrow shaft adjacent to the fetching end. A cylindrical bore extends into the arrow shaft at the fetching end, the bore having an exterior diameter to frictionally fit into the bore of the arrow shaft, and has a rearward end of a diameter essentially equal to that of the exterior diameter of the arrow shaft, the inboard end being formed with a deep hole for an acute angle bowstring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
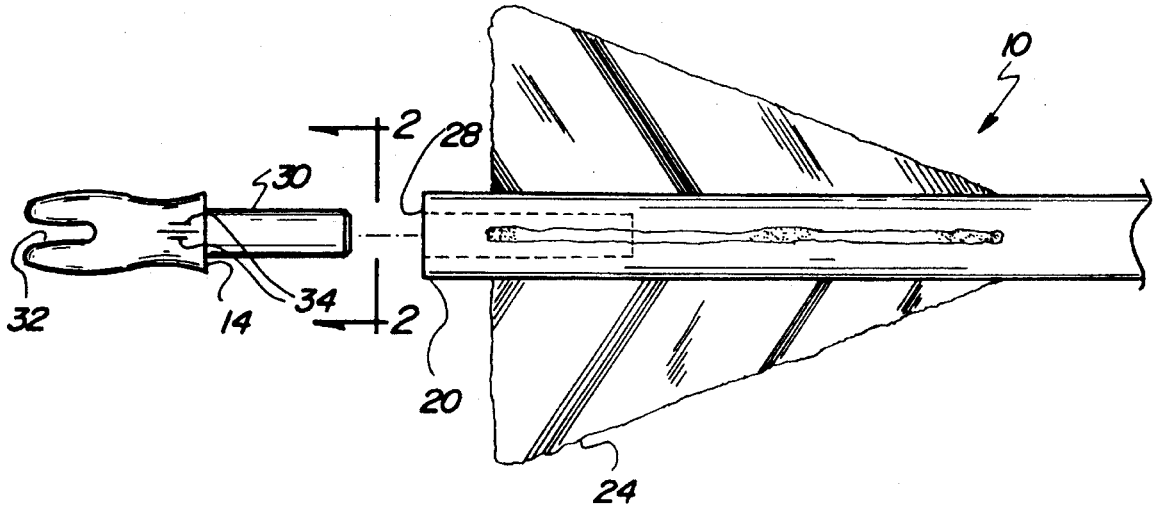
FIG. 1 is a side elevational view of the preferred embodiment of the arrows with reduced diameter nocks constructed in accordance with the principles of the present invention.

With reference now to the drawings, and in particular to FIG. 1 thereof, the preferred embodiment of the new and improved arrows with reduced diameter nocks embodying the principles and concepts of the present invention and generally designated by the reference numeral 10 will be described.

Figure 2:
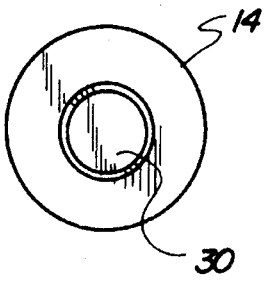
FIG. 2 is an end view of the nock taken along line 2—2 of FIG. 1.
Figure 3:
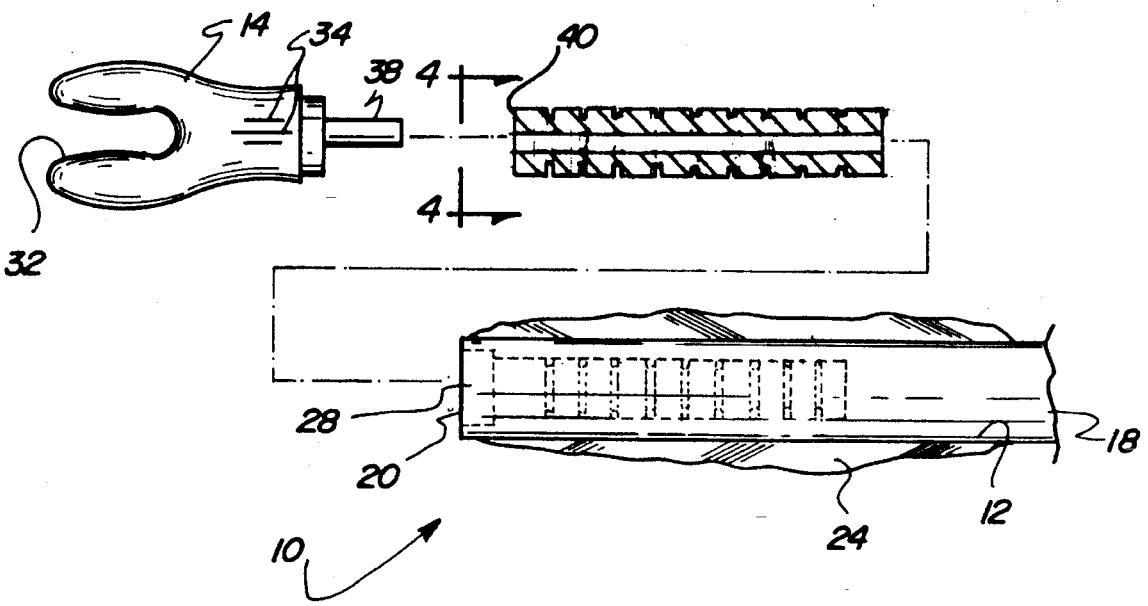
FIG. 3 is an exploded perspective view of an arrow and nock constructed in accordance with an alternate embodiment of the invention.

Specifically, it will be noted with reference to FIGS. 1 and 2 that the present invention relates to a new and improved arrow 10 with a reduced diameter nock 14. In its broadest terms, the arrow 10 is comprised of a shaft 12 and a nock 14.

More specifically, the arrow shaft 12 is a rigid cylindrical member having a pointed end 18 and a fetching end 20. The shaft has an exterior diameter and an interior diameter which is constant along its length. Fetching 24 is provided to extend radially outwardly from the arrow shaft adjacent to the fetching end 20. A cylindrical bore 28 extends into the arrow shaft 12 at the fetching end 20. The bore 28 has an internal diameter which is the internal diameter of the shaft 12.

Next provided is the nock 14. The nock has a cylindrical forward end 30 with an external diameter to frictionally fit into the bore 28 of the arrow shaft 12. The nock also has a rearward end with an exterior diameter essentially equal to that of the exterior diameter of the arrow shaft 12. The inboard end of the nock is formed with a deep hole 32 for an acute angle bowstring. Axial lines 34 on the nock 14 provide assistance in the rotational orientation of the nock 14 with respect to the shaft 12.

In an alternate embodiment of the invention, the forward end of the nock 14 is formed as a slender cylinder 38 with a diameter less than that of the bore 28. A bearing shoulder is thus formed at the juncture of the slender cylinder and the cylindrical forward end of the nock.

A supplemental shaft 42 is provided with indented rings at measured intervals of equal weight which can be cut to desired length or weight.

The shaft 38 is frictionally fit inside the bore 40 of the supplemental shaft 42 to ensure proper bonding and also rotational adjustment for clearance of fletchings over the arrow rest.

The present invention is a new style of nock which fits inside the shaft of an arrow, preferably a carbon arrow, and is fixed in place with friction. This results in a more accurate arrow. Current carbon arrows have their nocks place over the ends of the shaft which results in an inferior flight of the arrow. The present invention overcomes this by having the exterior diameter of the nock essentially equal to the exterior diameter of the arrow. The product would be mass-produced through a plastic injection-molding technique. It would have benefit to bow hunters, tournament archers, leisure archers and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved arrow with a reduced diameter nock comprising, in combination:

a cylindrical arrow shaft (12) in a tubular configuration having a pointed end and a fletching end and an exterior diameter and an interior diameter;

fletching extending outwardly from the arrow shaft from the fetching end;

a cylindrical bore (28) extending into the arrow shaft at the fletching end, the bore having an internal diameter;

a nock having a forward end and a rearward end, the rearward end having a diameter essentially equal to the exterior diameter of the arrow shaft, the forward end having a first cylindrical portion (30) abutting the rearward end and extending forwardly therefrom, the first cylindrical portion having an exterior diameter to frictionally fit into the bore (28) of the arrow shaft, the forward end having a second slender cylindrical portion (38) extending forwardly from the first cylindrical portion, the second cylindrical portion having an external diameter less than that of the bore (28) and the first cylindrical portion, thereby forming a bearing shoulder at the junction of the first and second portions; and a cylindrical supplemental shaft (42) positioned in the arrow shaft at the fletching end ahead of the nock, the supplemental shaft having a second cylindrical bore (40), the external diameter of the second cylindrical portion of the forward end of the nock being such that the second cylindrical portion has a frictional fit in the bore of the supplemental shaft thereby to insure proper bonding and rotational adjustability of the nock.

2. The arrow as set forth in claim 1 and further including:

indented rings formed in the supplemental shaft at measure intervals whereby the supplemental shaft can be cut to a desired length or weight.

* * * * *